US009506466B2

(12) United States Patent
Ebihara et al.

(10) Patent No.: US 9,506,466 B2
(45) Date of Patent: Nov. 29, 2016

(54) GEAR PUMP

(71) Applicant: JTEKT Corporation, Osaka-shi (JP)

(72) Inventors: Tsuyoshi Ebihara, Okazaki (JP); Teppei Morita, Okazaki (JP); Katsuhisa Udo, Nagoya (JP)

(73) Assignee: JTEKT CORPORATION, Osaka-shi (JP)

( * ) Notice: Subject to any disclaimer, the term of this patent is extended or adjusted under 35 U.S.C. 154(b) by 168 days.

(21) Appl. No.: 14/339,603

(22) Filed: Jul. 24, 2014

(65) Prior Publication Data

US 2015/0030488 A1 Jan. 29, 2015

(30) Foreign Application Priority Data

Jul. 24, 2013 (JP) ..... 2013-153699

(51) Int. Cl.

| | |
|---|---|
| ***F01C 21/18*** | (2006.01) |
| ***F03C 2/08*** | (2006.01) |
| ***F04C 2/08*** | (2006.01) |
| ***F04C 15/06*** | (2006.01) |
| ***F04C 2/10*** | (2006.01) |
| ***F04C 15/00*** | (2006.01) |

(52) U.S. Cl.

CPC ..... *F04C 2/10* (2013.01); *F04C 2/086* (2013.01); *F04C 2/102* (2013.01); *F04C 15/0026* (2013.01); *F04C 15/0049* (2013.01); *F04C 2250/101* (2013.01)

(58) Field of Classification Search

CPC F04C 15/0026; F04C 15/0049; F04C 2/086; F04C 2/102; F04C 2250/101

USPC ..... 418/171, 166, 75, 206.4, 167, 80, 81

See application file for complete search history.

(56) References Cited

U.S. PATENT DOCUMENTS

| | | | | |
|---|---|---|---|---|
| 3,995,978 | A * | 12/1976 | Khan | F04C 2/102 418/171 |
| 4,836,760 | A * | 6/1989 | MacLeod | F04C 15/06 418/166 |
| 6,481,991 | B2 * | 11/2002 | Takagi | F04C 15/0049 184/6.23 |
| 2004/0202564 | A1 * | 10/2004 | Ike | F04C 2/086 418/171 |
| 2010/0215537 | A1 | 8/2010 | Chang | |

FOREIGN PATENT DOCUMENTS

| | | |
|---|---|---|
| JP | 2005-76542 | 3/2005 |
| JP | 2010-96011 A | 4/2010 |
| WO | WO 2006/136014 A1 | 12/2006 |

OTHER PUBLICATIONS

Extended European Search Report issued Oct. 15, 2014 in Patent Application No. 14177941.3.

* cited by examiner

*Primary Examiner* — Kenneth Bomberg
*Assistant Examiner* — Deming Wan
(74) *Attorney, Agent, or Firm* — Oblon, McClelland, Maier & Neustadt, L.L.P.

(57) ABSTRACT

In a gear pump, an outer rotor and an inner rotor are disposed in a rotor installation chamber defined by a pump body and a pump cover. A suction port groove and a discharge port groove are formed in at least one of the pump body and the pump cover. A narrowing portion is formed at a portion of a radially outer side wall portion of the suction port groove, the portion being close to a terminal end wall portion of the suction port groove. The narrowing portion narrows the groove width in the radial direction. A pressurizing region that pressurizes oil in the gear chamber is formed between the narrowing portion and the terminal end wall portion.

10 Claims, 5 Drawing Sheets

GEAR PUMP

INCORPORATION BY REFERENCE

The disclosure of Japanese Patent Application No. 2013-153699 filed on Jul. 24, 2013 including the specification, drawings and abstract is incorporated herein by reference in its entirety.

BACKGROUND OF THE INVENTION

1. Field of the Invention

The invention relates to an internal gear pump used in, for example, an automatic transmission, or a continuously variable transmission.

2. Description of the Related Art

In an internal gear pump, a rotor installation chamber is defined by a pump body and a pump cover. In the rotor installation chamber, there are disposed an outer rotor (referred also to as "driven gear") having a plurality of internal teeth and an inner rotor (referred also to as "drive gear") having external teeth that define gear chambers in cooperation with the internal teeth and that are driven to be rotated while being engaged with the internal teeth. There is a known gear pump having a structure in which a suction port groove that forms a suction port and a discharge port groove that forms a discharge port are formed in at least one of a pump body and a pump cover. In this kind of gear pump, when an inner rotor is driven to be rotated at a high speed, the amount of oil sucked into the gear chambers, which are defined between the internal teeth and the external teeth, from the suction port groove is likely to be insufficient. Due to insufficient suction of the oil into the gear chambers defined between the internal teeth and the external teeth, cavitation occurs, and thus the discharge amount of oil may decrease or hydraulic vibrations, abnormal noise or the like may occur. In order to suppress occurrence of cavitation in gear chambers of a gear pump, for example, a gear pump described in Japanese Patent Application Publication No. 2005-76542 (JP 2005-76542 A) may be adopted. In this gear pump, steps extending in the rotation direction of a pump gear are formed at the bottoms of suction ports formed respectively in a pump body and a pump cover that accommodate the pump gear. The depth of a portion of the bottom of each suction port, the portion being located radially inward of the step, is set larger than the depth of the remaining portion of the bottom of each suction port, the remaining portion being located radially outward of the step.

In the gear pump described in JP 2005-76542 A, although air bubbles in the sucked oil are collected in a radially inner side portion of the suction port, part of the air bubbles are accumulated in gear chambers defined between internal teeth and external teeth. Then, the oil that contains air bubbles is discharged to a discharge port. Thus, the discharge amount of oil may decrease.

SUMMARY OF THE INVENTION

One object of the invention is to provide a gear pump configured to appropriately suppress occurrence of cavitation.

A gear pump according to an aspect of the invention includes: a pump body; a pump cover; an outer rotor having a plurality of internal teeth; and an inner rotor having external teeth meshed with the internal teeth and driven to be rotated. A rotor installation chamber is defined by the pump body and the pump cover. The outer rotor and the inner rotor are disposed in the rotor installation chamber, and gear chambers are defined between the internal teeth of the outer rotor and the external teeth of the inner rotor. A suction port groove that forms a suction port and a discharge port groove that forms a discharge port are formed in at least one of the pump body and the pump cover. A narrowing portion is formed at a portion of a radially outer side wall portion of the suction port groove, the portion being close to a terminal end wall portion of the suction port groove, the narrowing portion bulging toward a radially inner side wall portion of the suction port groove to narrow a groove width in a radial direction. A pressurizing region is formed between the narrowing portion and the terminal end wall portion, the pressurizing region pressurizing oil in the gear chamber that is defined between the internal tooth and the external tooth located at a position on the suction port groove side and closest to the terminal end wall portion.

In the gear pump according to the above aspect, the pressurizing region is defined by the narrowing portion formed at the portion of the radially outer side wall portion of the suction port groove, the portion being close to the terminal end wall portion. In the pressurizing region, the oil pressurized under the action of centrifugal force in the gear chamber defined between the internal tooth and the external tooth located at a position on the suction port groove side and closest to the terminal end wall portion of the suction port groove is restrained from flowing to the outside of the pressurizing region by the narrowing portion. Thus, it is possible to increase the pressure of the oil in the gear chamber and maintain the high-pressure state, thereby appropriately suppressing occurrence of cavitation. As a result, it is possible to suppress, for example, a decrease in the oil discharge amount, hydraulic vibrations, and abnormal noise, which are caused by the cavitation.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
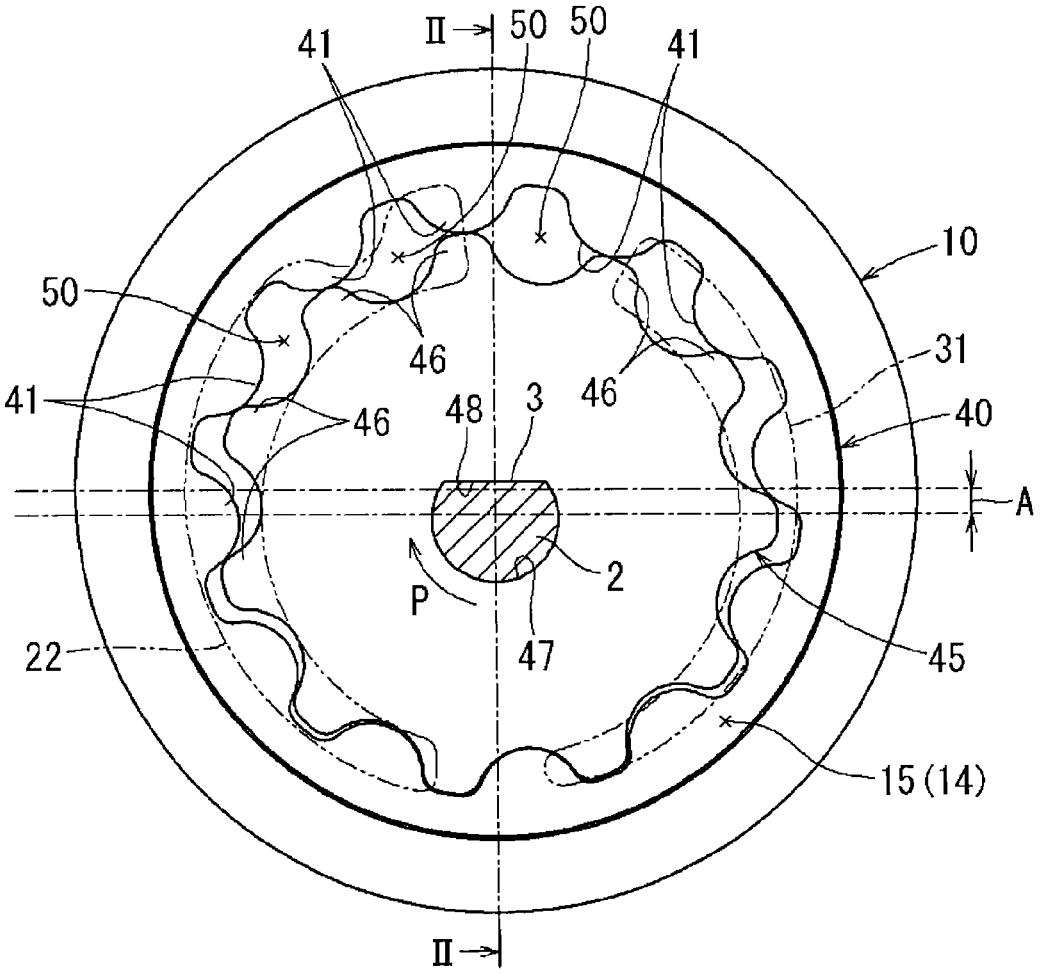
FIG. 1 is a front view illustrating the state where an outer rotor and an inner rotor are disposed in a rotor installation chamber of a gear pump according to a first embodiment of the invention.
Figure 2:
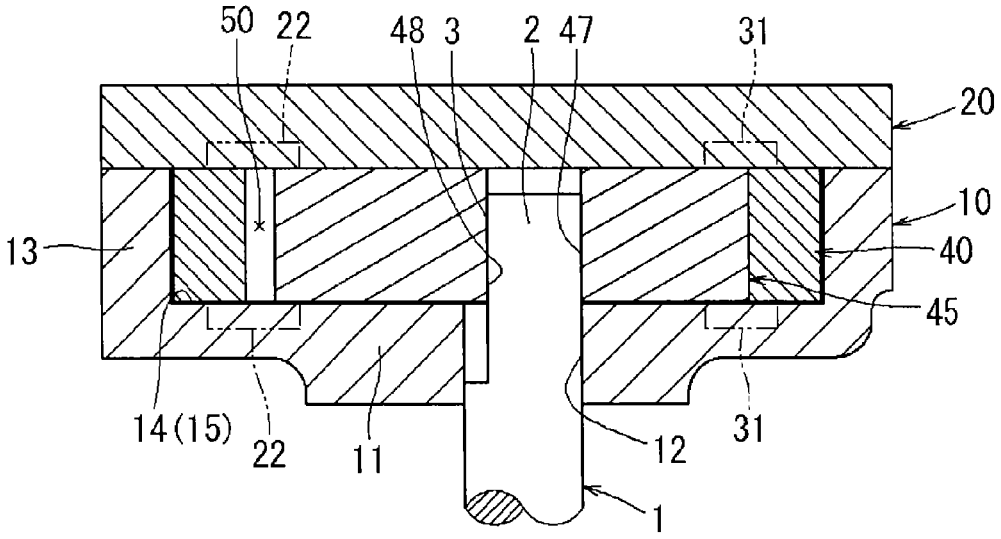
FIG. 2 is a sectional view of the gear pump taken along the line II-II in FIG. 1.

Hereinafter, example embodiments of the invention will be described in detail. A gear pump according to a first embodiment of the invention will be described with reference to the accompanying drawings. As illustrated in FIG. 1 and FIG. 2, the gear pump includes a pump body 10, a pump cover 20, an outer rotor 40, an inner rotor 45, and a drive shaft 1. The pump body 10 has a disc-shaped bottom wall 11, and a peripheral wall 13 formed into a cylindrical shape along a peripheral edge portion of the bottom wall 11. A recessed portion 14 that opens toward one end of the pump body 10 is defined by the bottom wall 11 and the peripheral wall 13. The bottom wall 11 has a through-hole 12 of which the center is located at a position offset from the center of the bottom wall 11 by an amount corresponding to an eccentric amount A that is the distance between the center of the outer rotor 40 (describer later) and the center of the inner rotor 45 (described later). The pump cover 20 is hermetically attached to an end face of the peripheral wall 13 of the pump body 10 with, for example, bolts (not illustrated) to close the recessed portion 14 of the pump body 10. As a result, a rotor installation chamber 15 is formed.

As illustrated in FIG. 1 and FIG. 2, the outer rotor 40 is rotatably fitted in the rotor installation chamber 15. A plurality of internal teeth 41 is formed on the inner peripheral face of the outer rotor 40. The internal teeth 41 are arranged in the circumferential direction of the outer rotor 40. The inner rotor 45 is disposed radially inward of the inner peripheral face of the outer rotor 40 such that the center of the inner rotor 45 is offset from the center of the outer rotor 40 by the eccentric amount A. A plurality of external teeth 46 that engage with the internal teeth 41 of the outer rotor 40 is formed on the outer peripheral face of the inner rotor 45. The external teeth 46 are arranged in the circumferential direction of the inner rotor 45. Gear chambers 50 are defined between the internal teeth 41 of the outer rotor 40 and the external teeth 46 of the inner rotor 45 so as to be expandable and contractable. A non-circular shaft hole 47 is formed at a center portion of the inner rotor 45. A distal end portion 2 of the drive shaft 1, which has been passed through the through-hole 12 of the pump body 10, is inserted into the shaft hole 47. In the first embodiment, a flat face 3 is formed by chamfering the outer peripheral face of the distal end portion 2 of the drive shaft 1 in the axial direction of the drive shaft 1. Further, a flat portion 48 is formed in the inner peripheral face of the inner rotor 45, which defines the shaft hole 47, at such a position as to be opposed to the flat face 3. The flat portion 48 is formed so as to form the chord of an arc of the shaft hole 47. As the inner rotor 45 rotates upon reception of torque transmitted from the drive shaft 1, the outer rotor 40 is rotated in accordance with the rotation of the inner rotor 45 with the internal teeth 41 of the outer rotor 40 meshed with the external teeth 46 of the inner rotor 45. Thus, the pumping action is carried out.

As illustrated in FIG. 2, a suction port groove 22 and a discharge port groove 31 are formed in at least one of the pump body 10 and the pump cover 20. In the first embodiment, the suction port groove 22 and the discharge port groove 31 are formed in each of both the pump body 10 and the pump cover 20. Each suction port groove 22 forms a suction port, and has an arc shape in a front view of the gear pump. Each discharge port groove 31 forms a discharge port, and has an arc shape in the front view of the gear pump. The suction port groove 22 is connected to a suction path (not illustrated), and the discharge port groove 31 is connected to a discharge path (not illustrated).

Figure 3:
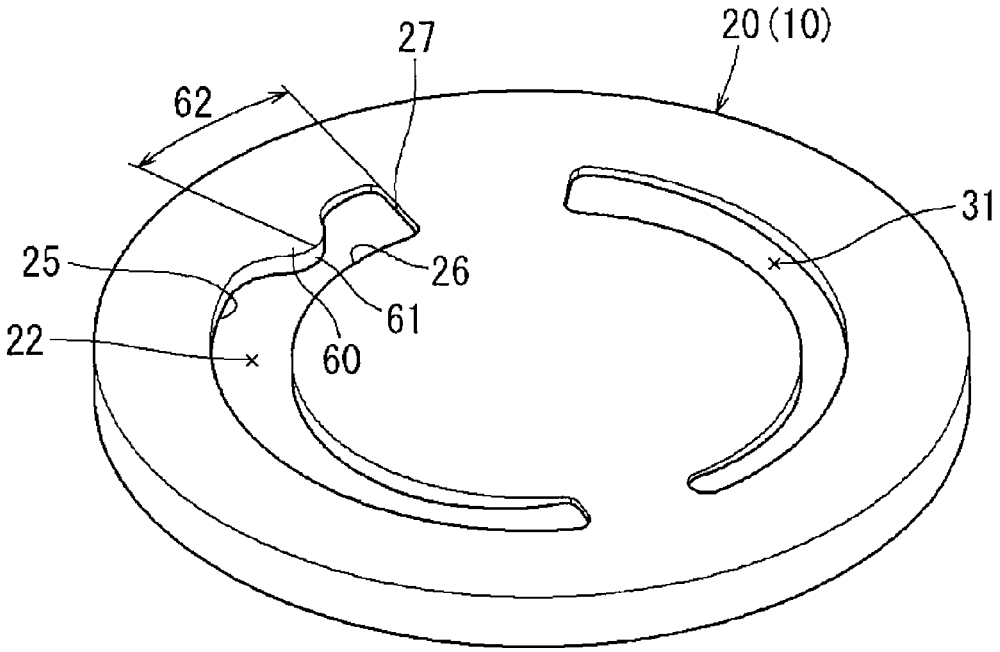
FIG. 3 is a perspective view illustrating a narrowing portion formed at a portion of a radially outer side wall portion of a suction port groove, the portion being close to a terminal end wall portion of the suction port groove.
Figure 4:
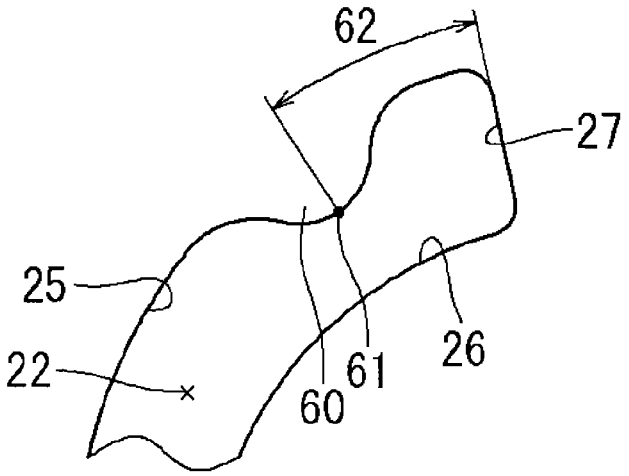
FIG. 4 is a front view illustrating the narrowing portion formed at the portion of the radially outer side wall portion of the suction port groove, the portion being close to the terminal end wall portion of the suction port groove.
Figure 5:
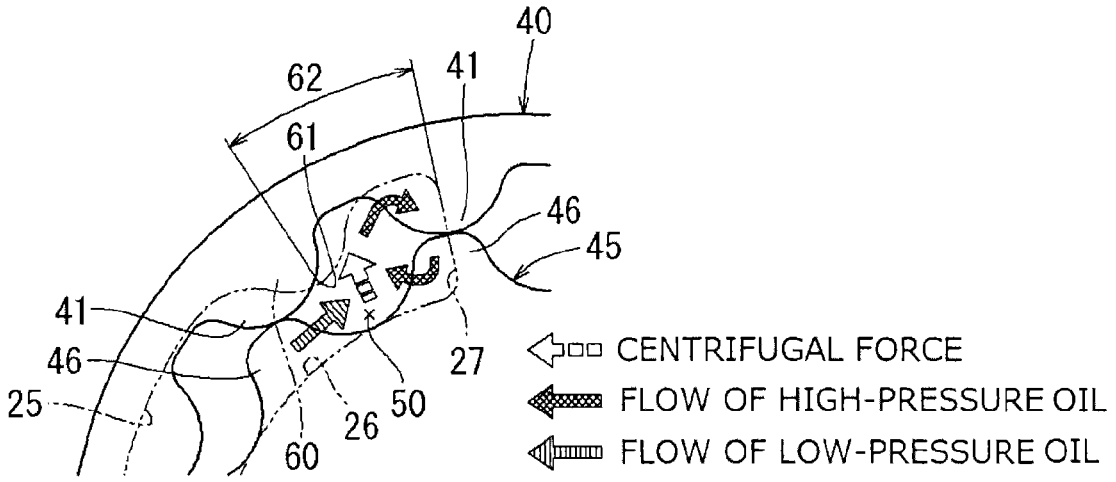
FIG. 5 is an explanatory view illustrating the state where oil is pressurized (the pressure of the oil is increased) in a pressurizing region defined by the narrowing portion.

As illustrated in FIG. 3 and FIG. 4, a narrowing portion 60 is formed at a portion of a radially outer side wall portion 25 of the suction port groove 22, the portion being close to a terminal end wall portion 27 of the suction port groove 22. The narrowing portion 60 bulges toward a radially inner side wall portion 26 of the suction port groove 22, thereby narrowing the groove width in the radial direction. In the embodiment, as illustrated in FIG. 3 to FIG. 5, the narrowing portion 60 bulges in a semi-arc chevron shape. A pressurizing region 62 is formed between a maximum narrowing portion 61, which is an apex of the narrowing portion 60, and the terminal end wall portion 27. The pressurizing region 62 is used to pressurize the oil in the gear chamber 50 that is defined between the internal tooth 41 and the external tooth 46 located at a position on the suction port groove 22 side and closest to the terminal end wall portion 27.

The bulging position of the narrowing portion 60 with respect to the radially outer side wall portion 25 of the suction port groove 22 is set such that the pressurizing region 62 is formed in a range from the terminal end wall portion 27 of the suction port groove 22 to a position that is apart from the terminal end wall portion 27 by a distance corresponding to one pitch of the internal teeth 41. The suction port groove 22 is formed such that the groove width in the radial direction gradually increases from the maximum narrowing portion 61 of the narrowing portion 60 toward the terminal end wall portion 27.

The gear pump according to the first embodiment is configured as described above. Thus, while the gear pump is operating, the inner rotor 45 is driven to be rotated clockwise in a direction indicated by an arrow P in FIG. 1 upon reception of torque transmitted from the drive shaft 1, and the outer rotor 40 is rotated in accordance with the rotation of the inner rotor 45. As the gear chambers 50 defined between the internal teeth 41 of the outer rotor 40 and the external teeth 46 of the inner rotor 45 are expanded and contracted, the oil supplied to the suction port groove 22 is sucked into the gear chambers 50 defined between the internal teeth 41 of the outer rotor 40 and the external teeth 46 of the inner rotor 45 and then discharged from the gear chambers 50 into the discharge port groove 31.

The flows of oil near the terminal end wall portion 27 of the suction port groove 22 during the pump operation are indicated by arrows in FIG. 5. That is, after the low-pressure oil located on the suction port groove 22 side is sucked into the gear chamber 50, the sucked oil flows radially outward under the action of centrifugal force and is pressurized (the pressure of the oil is increased). Part of the pressurized oil flows toward the terminal end wall portion 27 along the narrowing portion 60 of the suction port groove 22, flows along the terminal end wall portion 27, and flows toward the narrowing portion 60. Thus, the pressure of the oil is increased to a high pressure and the high-pressure state is maintained in the pressurizing region 62 defined by the narrowing portion 60 that bulges from a portion of the radially outer side wall portion 25, which is close to the terminal end wall portion 27 of the suction port groove 22.

As described above, it is possible to increase the pressure of the oil in the gear chamber 50 defined between the internal tooth 41 and the external tooth 46 located at a position on the suction port groove 22 side and closest to the terminal end wall portion 27 of the suction port groove 22. Thus, it is possible to appropriately suppress occurrence of cavitation in the oil in the gear chambers 50. As a result, it is possible to suppress, for example, a decrease in the oil discharge amount, hydraulic vibrations, and abnormal noise, which are caused by the cavitation.

In the first embodiment, the bulging position of the maximum narrowing portion 61 of the narrowing portion 60 with respect to the radially outer side wall portion 25 of the suction port groove 22 is set such that the pressurizing region 62 is formed in the range from the terminal end wall portion 27 of the suction port groove 22 to the position that is apart from the terminal end wall portion 27 by the distance corresponding to one pitch of the internal teeth 41 (the distance may be slightly smaller or larger than one pitch). Thus, it is possible to efficiently pressurize the oil (increase the pressure of the oil) in the gear chamber 50 defined between the internal tooth 41 and the external tooth 46 located at a position on the suction port groove 22 side and closest to the terminal end wall portion 27 of the suction port groove 22.

In the first embodiment, as illustrated in FIG. 3 and FIG. 4, the suction port groove 22 is formed such that the groove width in the radial direction gradually increases from the maximum narrowing portion 61 of the narrowing portion 60 toward the terminal end wall portion 27. Thus, the oil is smoothly suctioned in the gear chamber 50 defined between the internal tooth 41 and the external tooth 46 located at a position on the suction port groove 22 side and closest to the terminal end wall portion 27 of the suction port groove 22. As a result, it is possible to suppress occurrence of insufficient suction of oil.

Figure 6:
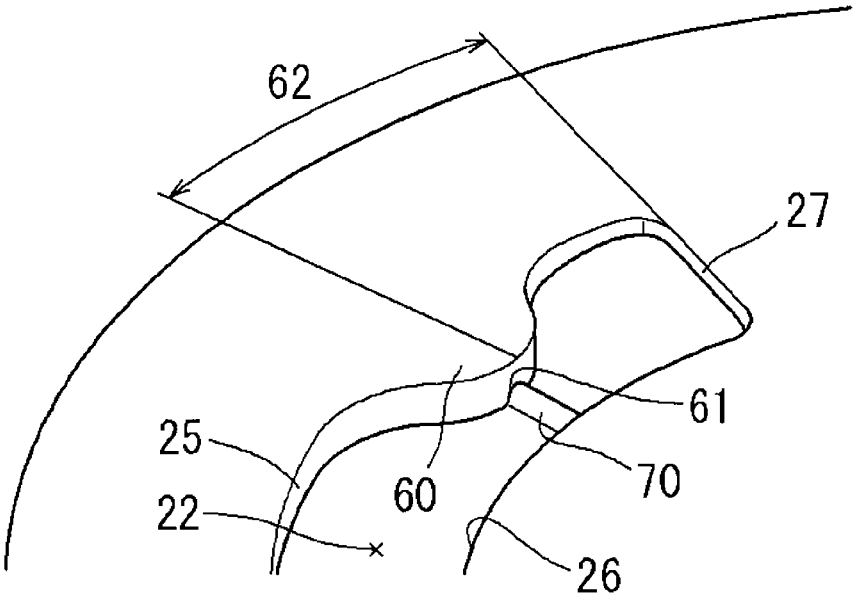
FIG. 6 is a perspective view illustrating the state where a portion with a smaller groove depth is formed in a suction port groove of a gear pump according to a second embodiment of the invention, the portion being located in a pressurizing region.
Figure 7:
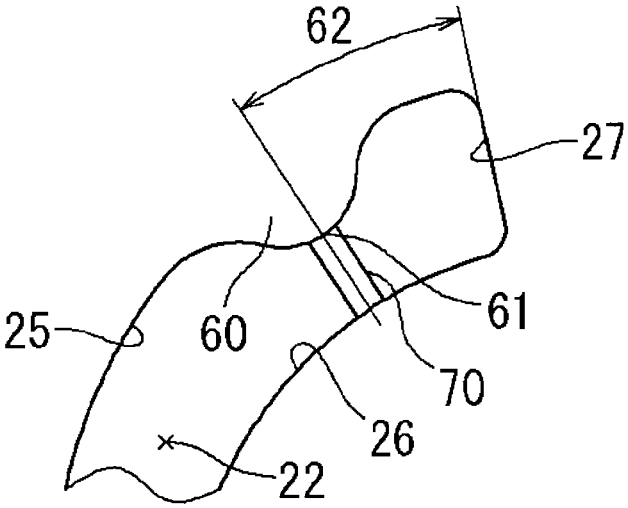
FIG. 7 is a front view illustrating the state where the portion with the smaller groove depth is formed in the pressurizing region.

Next, a second embodiment of the invention will be described with reference to FIG. 6 and FIG. 7. As illustrated in FIG. 6 and FIG. 7, in the second embodiment, a portion having a smaller groove depth is formed in the pressurizing region 62 defined by the narrowing portion 60 that bulges from the radially outer side wall portion 25 of the suction port groove 22. In the second embodiment, a projection 70, which has an arc sectional shape, projects from the groove bottom face, and extends in the radial direction, is formed at a position at the maximum narrowing portion 61 of the narrowing portion 60 of the suction port groove 22. Because the other configurations in the second embodiment are the same as those in the first embodiment, the same configurations as those in the first embodiment will be denoted by the same reference symbols as those in the first embodiment, and description thereof will be omitted.

In the second embodiment, the same operation and advantageous effects as those in the first embodiment are obtained. In particular, the projection 70 that forms a smaller groove-depth portion restrains the oil pressurized in the pressurizing region 62 from flowing into a portion of the suction port groove 22, the portion being located outside the pressurizing region 62. Thus, it is possible to efficiently pressurize the oil (increase the pressure of the oil) in the gear chamber 50 defined between the internal tooth 41 and the external tooth 46 located at a position on the suction port groove 22 side and closest to the terminal end wall portion 27 of the suction port groove 22. Thus, it is possible to further appropriately suppress occurrence of cavitation.

Figure 8:
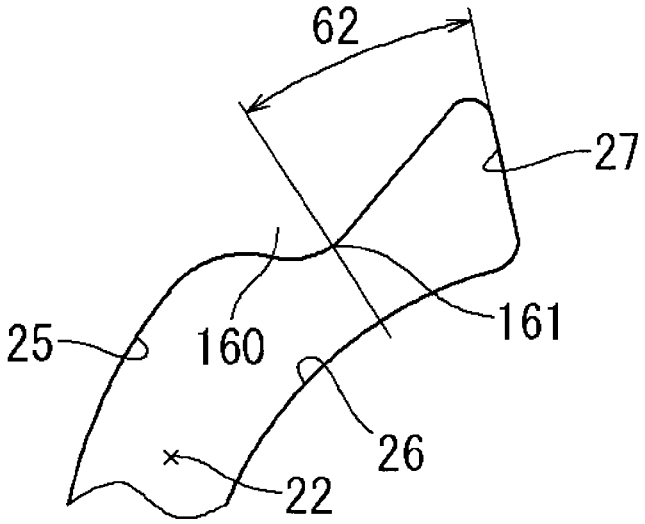
FIG. 8 is an explanatory view of a first modified example achieved by changing the shape of the groove from a maximum narrowing portion of the narrowing portion to the terminal end wall portion of the suction port groove.
Figure 9:
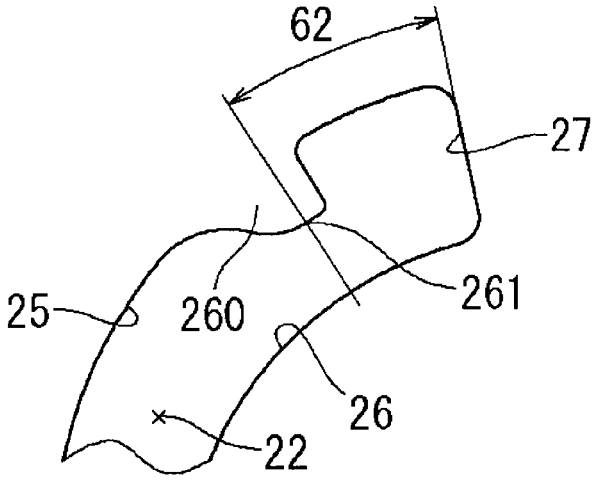
FIG. 9 is an explanatory view of a second modified example achieved by changing the shape of the groove from a maximum narrowing portion of the narrowing portion to the terminal end wall portion of the suction port groove.

The invention is not limited to the first and second embodiments, and may be implemented in various other embodiments within the scope of the invention. For example, in the first and second embodiments, the narrowing portion 60 bulges toward the radially inner side wall portion 26 of the suction port groove 22 from a portion of the radially outer side wall portion 25, the portion being close to the terminal end wall portion 27 of the suction port groove 22, thereby narrowing the groove width in the radial direction, and the narrowing portion 60 bulges in a semi-arc chevron shape. However, as illustrated in FIG. 8, a sloped narrowing portion 160 may be formed such that the groove width is gradually increased toward the radially outer side wall portion 25 from a maximum narrowing portion 161 of the narrowing portion 160 of the suction port groove 22. As illustrated in FIG. 9, a narrowing portion 260 may be formed into such a shape that the groove width is abruptly increased toward the radially outer side wall portion 25 from a maximum narrowing portion 261 of the narrowing portion 260 of the suction port groove 22. In the first and second embodiments, the suction port groove 22 that forms the suction port and the discharge port groove 31 that forms the discharge port are formed in each of both the pump body 10 and the pump cover 20. However, the invention may be implemented in the case where the suction port groove 22 and the discharge port groove 31 are formed in one of the pump body 10 and the pump cover 20.

What is claimed is:

1. A gear pump comprising:

a pump body;

a pump cover;

an outer rotor having a plurality of internal teeth;

an inner rotor having external teeth meshed with the internal teeth and able to be driven to be rotated;

a rotor installation chamber defined by the pump body and the pump cover, wherein the outer rotor and the inner rotor are disposed in the rotor installation chamber;

gear chambers defined between the internal teeth of the outer rotor and the external teeth of the inner rotor;

a suction port groove that forms a suction port, and a discharge port groove that forms a discharge port, provided in at least one of the pump body and the pump cover, wherein the suction port groove has a radially outer side wall; and means provided on the radially outer side wall of the suction port groove to induce pressurization by centrifugal force of oil in the gear chamber that is defined between the internal tooth and the external tooth and that is located at a position on the suction port groove side and closest to a terminal end wall portion of the suction port groove.

2. The gear pump according to claim 1, further comprising means for restraining the pressurized oil in the gear chamber located closest to the terminal end wall portion of the suction port groove from flowing back into the suction port groove.

3. A gear pump comprising:

a pump body;

a pump cover;

an outer rotor having a plurality of internal teeth;

an inner rotor having external teeth meshed with the internal teeth and able to be driven to be rotated;

a rotor installation chamber defined by the pump body and the pump cover, wherein the outer rotor and the inner rotor are disposed in the rotor installation chamber;

gear chambers defined between the internal teeth of the outer rotor and the external teeth of the inner rotor;

a suction port groove that forms a suction port, and a discharge port groove that forms a discharge port, provided in at least one of the pump body and the pump cover, wherein the suction port groove has a radially outer side wall and a radially inner side wall;

a narrowing portion of the suction port groove, the narrowing portion being provided at a portion of the radially outer side wall portion of the suction port groove, the narrowing portion being located close to a terminal end wall portion of the suction port groove, the narrowing portion bulging toward the radially inner side wall of the suction port groove to narrow a groove width of the suction port groove in a radial direction; and a pressurizing region provided between the narrowing portion and the terminal end wall portion, the pressurizing region pressurizing oil in the gear chamber that is defined between the internal tooth and the external tooth and that is located at a position on the suction port groove side and closest to the terminal end wall portion.

4. The gear pump according to claim 3, wherein a bulging position of the narrowing portion with respect to the radially outer side wall portion of the suction port groove is set such that the pressurizing region is formed in a range from the terminal end wall portion of the suction port groove to a position that is apart from the terminal end wall portion by a distance corresponding to one pitch of the internal teeth.

5. The gear pump according to claim 4, wherein the suction port groove has a portion with a groove depth smaller than that of the other portion of the suction port, the portion being located in the pressurizing region to restrain the pressurized oil in the gear chamber located closest to the terminal end wall portion of the suction port groove from flowing back into the suction port groove.

6. The gear pump according to claim 5, wherein the suction port groove is formed such that the groove width in the radial direction gradually increases from the narrowing portion toward the terminal end wall portion.

7. The gear pump according to claim 4, wherein the suction port groove is formed such that the groove width in the radial direction gradually increases from the narrowing portion toward the terminal end wall portion.

8. The gear pump according to claim 3, wherein the suction port groove has a portion with a groove depth smaller than that of the other portion of the suction port, the portion being located in the pressurizing region to restrain the pressurized oil in the gear chamber located closest to the terminal end wall portion of the suction port groove from flowing back into the suction port groove.

9. The gear pump according to claim 8, wherein the suction port groove is formed such that the groove width in the radial direction gradually increases from the narrowing portion toward the terminal end wall portion.

10. The gear pump according to claim 3, wherein the suction port groove is formed such that the groove width in the radial direction gradually increases from the narrowing portion toward the terminal end wall portion.

* * * * *